US008182002B2

(12) United States Patent
Fleming

(10) Patent No.: US 8,182,002 B2
(45) Date of Patent: May 22, 2012

(54) MULTIPOINT DOOR LOCK SYSTEM WITH HEADER AND SILL LOCK PINS

(75) Inventor: Paul D. Fleming, Glendale, CA (US)

(73) Assignee: W & F Manufacturing, Inc., Sun Valley, CA (US)

( * ) Notice: Subject to any disclaimer, the term of this patent is extended or adjusted under 35 U.S.C. 154(b) by 1186 days.

(21) Appl. No.: 11/861,431

(22) Filed: Sep. 26, 2007

(65) Prior Publication Data

US 2008/0078216 A1 Apr. 3, 2008

Related U.S. Application Data

(60) Provisional application No. 60/827,905, filed on Oct. 3, 2006.

(51) Int. Cl.
*E05C 9/10* (2006.01)

(52) U.S. Cl. ..... 292/40; 292/68; 292/158; 292/DIG. 62

(58) Field of Classification Search ..... 292/40, 292/7, 14, 16, 36, 37, 46–49, 65, 66, 68 X, 292/156, 157, 158 X, 159, 173, DIG. 62 X, 292/DIG. 21

See application file for complete search history.

(56) References Cited

U.S. PATENT DOCUMENTS

| | | | | | |
|---|---|---|---|---|---|
| 958,880 | A * | 5/1910 | Lawson | 292/335 |
| 4,005,886 | A * | 2/1977 | Lirette | 292/177 |
| 4,643,005 | A * | 2/1987 | Logas | 70/95 |
| 5,290,077 | A | 3/1994 | Fleming | |
| 5,595,408 | A * | 1/1997 | Jeche | 292/37 |
| 6,971,686 | B2 * | 12/2005 | Becken | 292/39 |
| 2007/0080541 | A1 | 4/2007 | Fleming | |

* cited by examiner

*Primary Examiner* — Carlos Lugo
*Assistant Examiner* — Mark Williams
(74) *Attorney, Agent, or Firm* — Lowry Blixseth LLP; Scott M. Lowry; Stuart O. Lowry

(57) ABSTRACT

An improved multipoint door lock system of the type described in U.S. Pat. No. 5,290,077 additionally includes header and sill lock pins actuated by lost motion mechanisms for respective movement from a retracted position to an advanced deadbolt locking position engaged with respective header and sill keepers, in response to movement of one or more latch bolts from a normal latched position to a further extended deadbolt position. The latch bolts are further movable between the normal latched position engaged with associated strike sets on the adjacent door jamb for maintaining the door in a closed position, and a retracted position to permit swinging movement of the door to an open position. The lost motion mechanisms associated with the header and sill pins accommodate latch bolt movement between the latched and retracted positions, without displacing the header and sill pins.

15 Claims, 17 Drawing Sheets

MULTIPOINT DOOR LOCK SYSTEM WITH HEADER AND SILL LOCK PINS

BACKGROUND OF THE INVENTION

This invention relates generally to improvements in door latch and lock systems of the general type disclosed in U.S. Pat. No. 5,290,077, having multiple bolt-type members to achieve secure multipoint closure and locking of a door, such as an entry door for a residence or business establishment. More specifically, this invention relates to an improved door lock system having at least one latch bolt mounted along a free side edge of the door for engagement with an associated strike set on the adjacent door jamb, wherein said at least one latch bolt is movable from a normal latched position to a further extended deadbolt position to perform a deadbolt locking function. The improved system of the present invention is directed to additional header and/or sill lock pins for movement with said at least one latch bolt from a normally retracted position to an advanced deadbolt locking position engaged with respective header and/or sill keepers, in response to latch bolt displacement to the further extended deadbolt position.

Door latch and lock assemblies for use with hinged swinging doors are generally known in the art, and typically include at least one movable lock member mounted at a selected vertical position along a free side edge of the door in proximity with an actuator positioned for convenient manual access and operation. For example, a spring-loaded latch bolt is normally mounted on the door at a mid-height position and springably projects from the free side edge of the door to engage a strike or keeper plate mounted on the adjacent door jamb, to retain the door in a normal closed and latched position. A handle or lever, typically of rotary design, is commonly included as part of the latch and lock assembly, and is adapted for manual displacement to retract the latch bolt from the strike plate and thereby permit the door to be opened. In some door hardware designs, such as typically higher-end hardware, a rotary handle or lever is replaced by a relatively large and more decorative fixed handle in combination with a relatively small actuator lever positioned for thumb-depression to retract the latch bolt. Other designs have proposed a pivotally mounted hand-grip style lever for manually retracting the latch bolt, as disclosed, e.g., in U.S. Application 60/724,647, now U.S. Ser. No. 11/538,175, published as U.S. Publication 2007/0080541, which is incorporated by reference herein. Such lock assemblies commonly include at least one lock device which may be designed to preclude latch bolt retraction in the locked condition, and/or may comprise a separate deadbolt for use in selectively locking the door.

Although such door latch and lock assemblies as described above have generally performed their latching and/or locking functions in a satisfactory manner, there has been an on-going desire and need for further improvements in entry door security for residences and business establishments. Toward this end, so-called multipoint lock assemblies have been developed wherein multiple lock members such as multiple retractable latch bolts are provided at vertically spaced positions along the free side edge of the door for engaging a corresponding number of strike plates mounted at corresponding positions on the adjacent door jamb. In some designs, the multiple lock members are adapted for independent actuation, with the unfortunate result that frequently only one of the lock members is engaged due to human forgetfulness and/or neglect. In other designs, the multiple lock members are adapted for concurrent actuation by means of a single rotary-mounted operator handle or lever.

U.S. Pat. No. 5,290,077, which is incorporated by reference herein, discloses an exemplary multipoint door lock assembly including multiple retractable latch bolts mounted at vertically spaced positions along the free side edge of an entry door or the like. A primary latch bolt is positioned generally at a mid-height location in close proximity with an actuator mechanism. A pair of secondary latch bolts are respectively positioned vertically above and below the primary latch bolt, and are linked by slide-mounted extension rods with the actuator mechanism. Rotary-mounted lever handles or the like mounted respectively at outboard and inboard sides of the door are manually grasped and individually rotated to operate the actuator mechanism to retract all three latch bolts in a substantially concurrent manner. When the rotary lever handle is released, one or more springs incorporated into the mechanism cause the latch bolts (and lever handle) to return automatically and substantially concurrently to a normal latched position. As is known in the art, each latch bolt normally includes one tapered face to accommodate automatic spring-loaded retraction as the latch bolt engages the associated strike plate during door closure movement, followed by automatic re-extension of the latch bolt to the normal latched position extending into a strike plate keeper recess as the door reaches the closed position. For enhanced security, the latch bolts are further movable from the normal latched position to a further extended deadbolt position projecting a further distance into the strike plate recess, wherein this extended deadbolt position can be associated with disablement of the outboard or outdoor-side lever handle.

Multipoint door lock assemblies of the type shown and described in U.S. Pat. No. 5,290,077 beneficially provide enhanced security against unauthorized entry or tampering. In addition, multipoint lock assemblies have demonstrated significantly improved capacity to retain the door in a securely closed and locked position when subjected to adverse weather conditions, particularly such as strong hurricane-force winds. As such, these multipoint door lock assemblies are becoming increasingly popular.

The present invention relates to further improvements in and to multipoint door lock assemblies, particularly of the type shown and described in U.S. Pat. No. 5,290,077, wherein the door lock assembly further includes one header and/or sill lock pin movable into secure locked engagement with an associated header and/or sill keeper, in response to movement of at least one latch bolt to an advanced deadbolt locking position.

SUMMARY OF THE INVENTION

In accordance with the invention, an improved multipoint door lock system is provided of the general type described in U.S. Pat. No. 5,290,077 and additionally including header and/or sill lock pins actuated by lost motion mechanisms for respective movement from a retracted position to an advanced deadbolt locking position engaged with respective header and sill keepers, in response to movement of one or more latch bolts from a normal latched position to a further extended deadbolt position.

In one preferred form, a swinging door is hingedly mounted within a door frame, or as part of a double door set, such as an entry door for a residence or business establishment. A multipoint latch and lock assembly in mounted generally at a free side edge of the swinging door, wherein this door latch and lock assembly is constructed generally according to U.S. Pat. No. 5,290,077, which is incorporated by reference herein. The door latch and lock assembly generally includes a main lock cartridge mounted generally at a mid-height position in association with indoor and outdoor actuators such as rotatably mounted lever handles or the like. The main lock cartridge, in the preferred form, is linked as by extension rods to a pair of secondary lock cartridges mounted at spaced positions respectively above and below the main lock cartridge. Each lock cartridge, main and secondary, includes a spring-loaded latch bolt disposed in a normal latched position projecting from the door side edge for engagement with an associated strike set mounted on the adjacent door jamb, or on an adjacent door of a double door set, to maintain the door in a closed position. Either one of the indoor and outdoor actuators is operable through the main lock cartridge for concurrently shifting the latch bolts to a retracted position permitting the door to be opened. In addition, a thumbturn actuator or the like is operable through the main lock cartridge to displace the latch bolts from the normal latched position to a further extended deadbolt position.

The improved multipoint lock system of the present invention further incorporates a pair of header and sill cartridges linked to the main lock cartridge for respectively controlling the positions of a pair of header and sill lock pins engageable respectively with a corresponding pair of slotted header and sill keepers on the adjacent door frame. In particular, these header and sill lock cartridges each include a lost motion mechanism coupled between the extension rods and the respective header or sill lock pin. The lost motion mechanisms retain the header and sill lock pins in a retracted position throughout latch bolt displacement between the normal latched and retracted positions. However, when the latch bolts are shifted to the further extended deadbolt positions, the lost motion mechanisms are designed to throw the header and sill pins quickly and easily to extended deadbolt positions engaged with the respective header and sill keepers. Upon return displacement of the latch bolts from the deadbolt positions to the normal latched or retracted positions, the lost motion mechanisms respond by shifting the header and sill lock pins back to their respective retracted positions.

In one form, the projecting tips of the header and sill lock pins, engageable with the respective keepers on the door frame, have a tapered profile to insure engagement with the associated keeper nothwithstanding door bowing which may occur as a result of indoor-outdoor temperature differentials, or the passage of time and associated weathering of the door structure.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
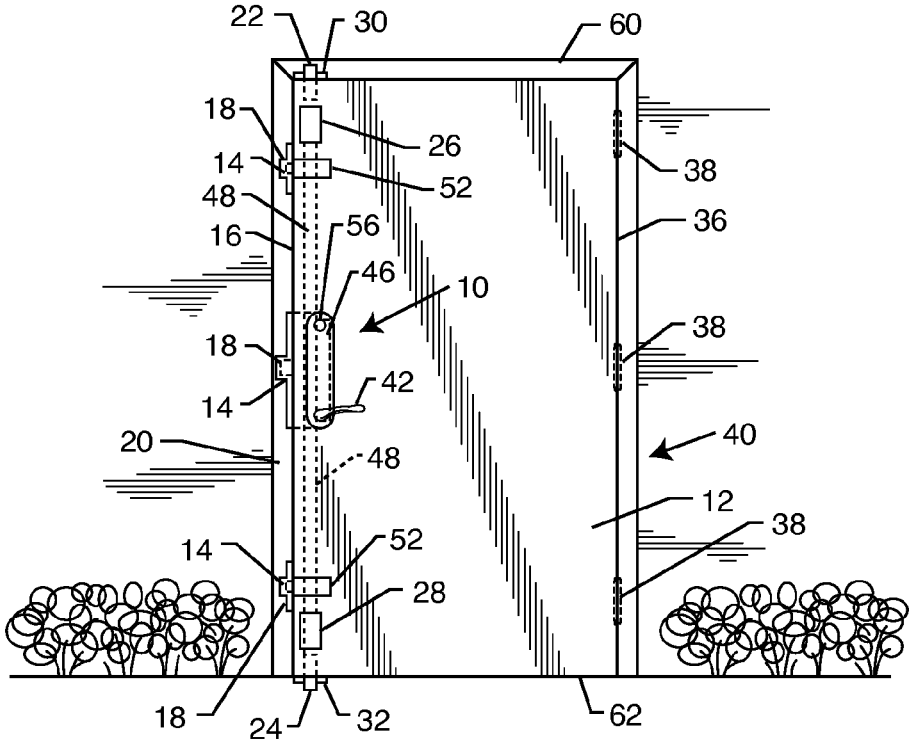
FIG. 1 is an outdoor side elevation view depicting a swinging door equipped with a multipoint lock system constructed in accordance with one preferred form of the present invention.

As shown in the exemplary drawings, an improved door lock system referred to generally by the reference numeral 10 in FIG. 1 is provided for securely retaining a door 12, such as an entry door for a residence of place of business, in a closed and selectively deadbolt-locked position. The illustrative door lock system 10 is constructed generally as shown and described in U.S. Pat. No. 5,290,077 to include at least one and preferably multiple latch bolts 14 mounted at a free side edge 16 of the door 12 for respectively engaging associated strike sets 18 mounted on the adjacent doorjamb 20, and wherein these latch bolts 14 are adapted for selective further extension beyond a normal latched position to an extended deadbolt position. In accordance with the invention, the improved door lock system 10 further includes a header lock pin 22 and/or a sill lock pin 24 actuated by associated lost motion mechanisms 26 and 28 for movement to an advanced deadbolt locking position engaged with respective header and sill keepers 30 and 32, in response to latch bolt movement to the further extended deadbolt positions.

The door lock system 10 generally comprises a multipoint latch and lock assembly to provide an increased level of security when the door 12 is in a closed and locked condition. The multiple latch bolts 14 are mounted in vertically spaced relation along the free side edge 16 of the door 12, for respective alignment with the associated strike sets 18 installed within the adjacent vertically extending stile or the like of the door jamb 20. During normal operation, the multiple latch bolts 14 are displaced between a normal latched position projecting from the door side edge 16 for respective reception into bolt ports 34 (FIGS. 4 and 5) formed in the strike sets 18 to maintain the door 12 in a closed and latched condition, and a retracted position withdrawn from the strike sets 18 and retracted substantially into the door edge 16 to permit movement of the door 12 to an opened condition. In this regard, FIG. 1 shows the illustrative door 12 in the form of a swinging door having a hinged edge 36 mounted as by means of vertically spaced hinge units 38 for swinging movement of the door 12 relative to a door frame 40 between said closed and opened positions.

Figure 2:
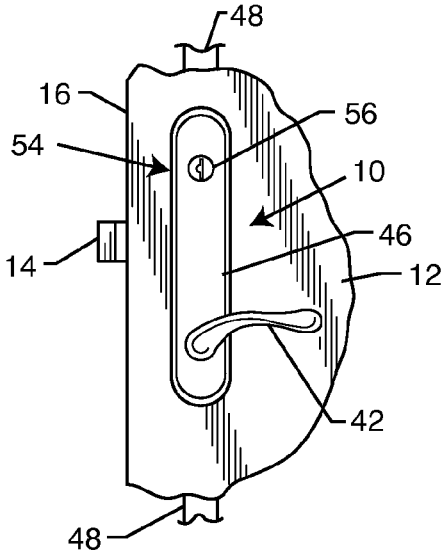
FIG. 2 is an enlarged and fragmented outboard side perspective view of a portion of the door and the door lock system depicted in FIG. 1.
Figure 3:
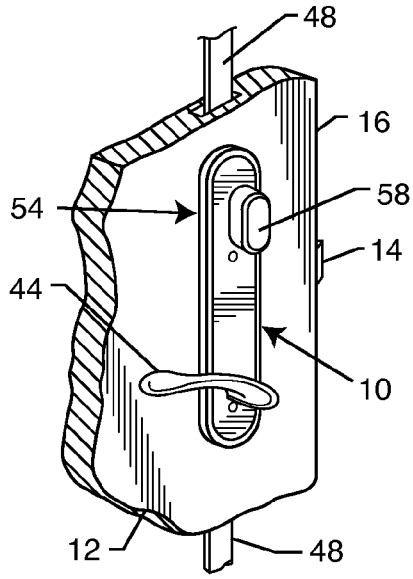
FIG. 3 is an enlarged and fragmented indoor side perspective view of a portion of the door and related door lock system depicted in FIG. 1.

An outdoor-side actuator 42 (FIG. 2) and an indoor-side actuator 44 (FIG. 3), such as the illustrative rotatable lever handles, are individually operable to displace the latch bolts 14 between the normal latched and retracted positions. These outdoor and indoor handles 42, 44 are rotatably carried by a main lock cartridge 46 associated with a mid-height mounted one of the latch bolts 14, and including internal linkage and spring means (not shown) for displacing the mid-height latch bolt 14 between the latched and retracted positions in response to individual lever handle rotation. Extensions rods 48 mounted within vertically elongated channels 50 (FIGS. 4 and 5) formed at the door free side edge 16 couple the main lock cartridge 46 with upper and lower secondary lock cartridges 52 associated respectively with upper and lower latch bolts 14. These secondary lock cartridges 52 respond to extension rod displacement for shifting the upper and lower latch bolts 14 between the latched and retracted positions substantially concurrently with the mid-height latch bolt 14. An additional deadbolt operator 54 (FIGS. 1-4) on the main lock cartridge 46 is operable for displacing the mid-height latch bolt 14 to the further extended deadbolt position, and for concurrently shifting the extension rods 48 to operate the secondary lock cartridges 52 in a manner achieving similar substantially concurrent displacement of the upper and lower latch bolts 14 to the further extended deadbolt position. In a preferred form as shown, this deadbolt operator 54 may include a keyed cylinder 56 accessible from the door exterior (FIG. 2) and a traditional thumbturn knob 58 (FIG. 3) or the like accessible from the door interior. In addition, for panic opening of the door, the indoor-side handle 44 can be adapted for retracting the latch bolts 14 from the extended deadbolt position to the retracted position, all as described in U.S. Pat. No. 5,290,077 which is incorporated by reference herein. By contrast, with the latch bolts 14 in the further extended deadbolt position, the outdoor-side handle 42 is inoperative to retract the latch bolts 14 for opening of the door.

To this point, the multipoint lock system 10 corresponds with the door latch and lock assembly shown and described in the above-referenced U.S. Pat. No. 5,290,077. Accordingly, further details of the mechanical linkages and actuator/operator structures for manipulating the multiple latch bolts 14 are not included herein. In addition, persons skilled in the art will recognize and appreciate that the illustrative multipoint lock system 10 may be used in a double door entry set, wherein the free side edge 16 of the swinging door 12 includes the multiple latch bolts 14 for engaging respective strike sets 18 on a free side edge of an adjacent and typically semi-active door of the double door entry set. Moreover, it will be understood that the invention may be employed with other types of closure panels other than doors, such as windows and shutters and the like, to achieve secure closure and locking thereof.

In accordance with the invention, the improved multipoint door lock system 10 further includes one or both of the header and sill lock pins 22, 24 for respectively engaging associated header and sill keepers 30, 32 located at the top or header 60 of the door frame 40, and at the bottom or sill or threshold 62 of the framed door opening. The header lock pin 22 is coupled to and displaced by a header cartridge 64 (FIG. 4) linked to an upper end of the extension rod 48 which projects upwardly to and a short distance beyond the associated upper secondary lock cartridge 52. Similarly, the sill lock pin 24 is coupled to and displaced by a sill cartridge 66 (FIG. 5) linked to a lower end of the extension rod 48 which projects downwardly to and a short distance beyond the associated lower secondary lock cartridge 52.

Figure 5:
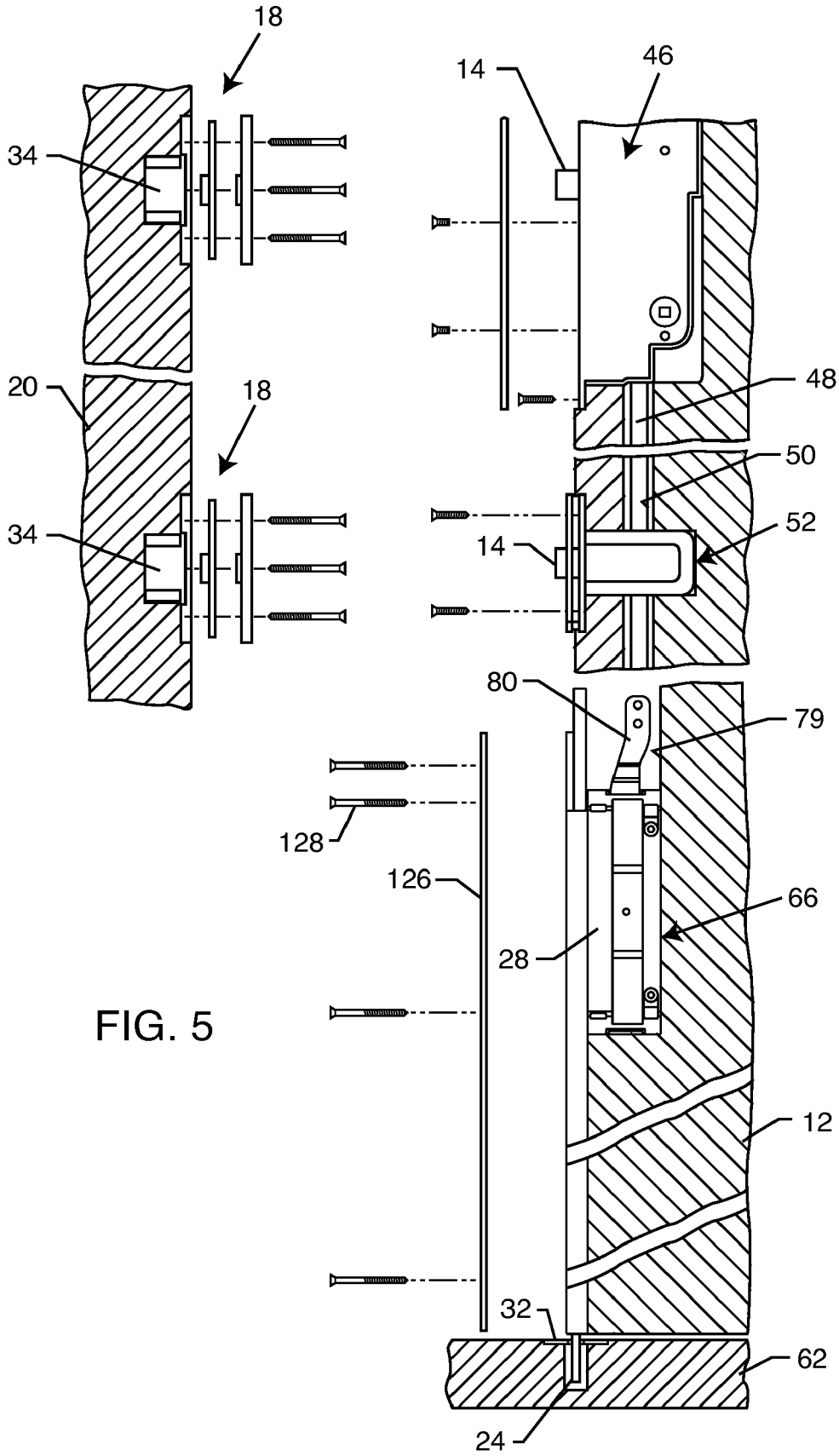
FIG. 5 is an enlarged and fragmented elevational view illustrating a lower portion of the multipoint door lock system of FIGS. 1-3, and depicted in association with strike sets mounted on a vertical stile of an adjacent door jamb, and further depicted in association with a keeper plate mounted on a horizontal sill of the adjacent door jamb.
Figure 8:
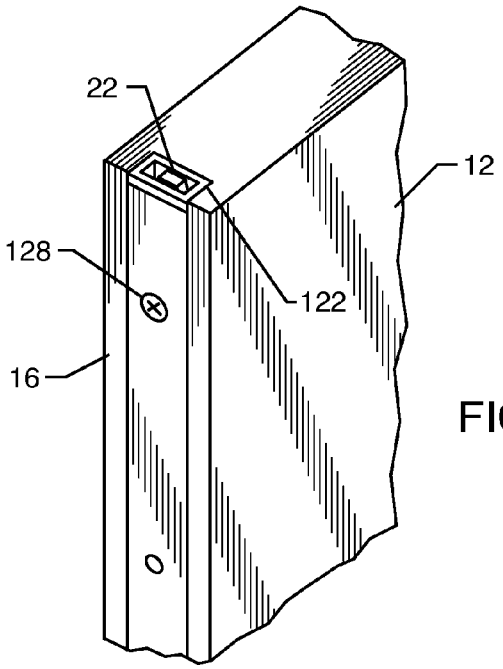
FIG. 8 is an enlarged and fragmented top perspective view of a portion of the door, an upper header lock pin in a normal retracted position.

In general terms, the header and sill lock cartridges 64, 66 respectively incorporate the header and sill lost motion mechanisms 26, 28 linked between the associated extension rod 48 and the header/sill lock pins 22, 24. Both header/sill lock pins 22, 24 are normally retained in a retracted position concealed substantially within the associated upper or lower edge of the door 12 (as shown in FIG. 8 with respect to the header lock pin 22), throughout normal movement of the latch bolts 14 between the normal latched and retracted positions. However, when the latch bolts 14 are shifted to their further extended deadbolt positions, the lost motion mechanisms 26, 28 shift the associated header/sill lock pins 22, 24 quickly and easily to an extended deadbolt position (shown in FIG. 9 with respect to the header lock pin 22) protruding from the associated upper or lower door edge for deadbolt-locked reception into the associated slotted keeper 30, 32. In this regard, FIG. 10 shows the header keeper 30 in the form of a metal keeper plate 68 fastened by screws 69 or the like into the header 60 of the door frame, wherein the plate 68 defines a slot 70 of appropriate size and shape for slide-fit reception of the tip end of the associated header lock pin 22. Persons skilled in the art will appreciate that the sill keeper 32 may have a similar construction, or otherwise be defined by a similarly sized and shaped slot formed directly in the door sill 62 (FIGS. 1 and 5).

In the extended deadbolt position, the header and/or sill lock pins 22, 24 provide additional securement points for retaining the door 12 in a safely and securely locked condition, with multiple or redundant locking points minimizing risk of authorized entry and/or undesired door opening in response, e.g., to strong winds such hurricane force winds. In this regard, the associated header and sill cartridges 64, 66 and the lost motion mechanisms 26, 28 therein are similarly but not identically constructed to achieve the desired operation of the header/sill lock pins 22, 24 in response to certain but not all vertical displacements of the extension rods 48. Specifically, upward displacement of the extension rods 48 in response to actuation of the deadbolt operator 54 causes the lost motion mechanisms 26, 28 to throw the header and sill lock pins 22, 24 respectively in opposite directions, namely, upwardly and downwardly, to their extended deadbolt positions. By contrast, normal downward displacement of the extension rods 48 in the course of shifting the latch bolts 14 between the normal latched and retracted positions is ineffective to displace the header and sill lock pins 22, 24 from their normal retracted positions.

Figure 6:
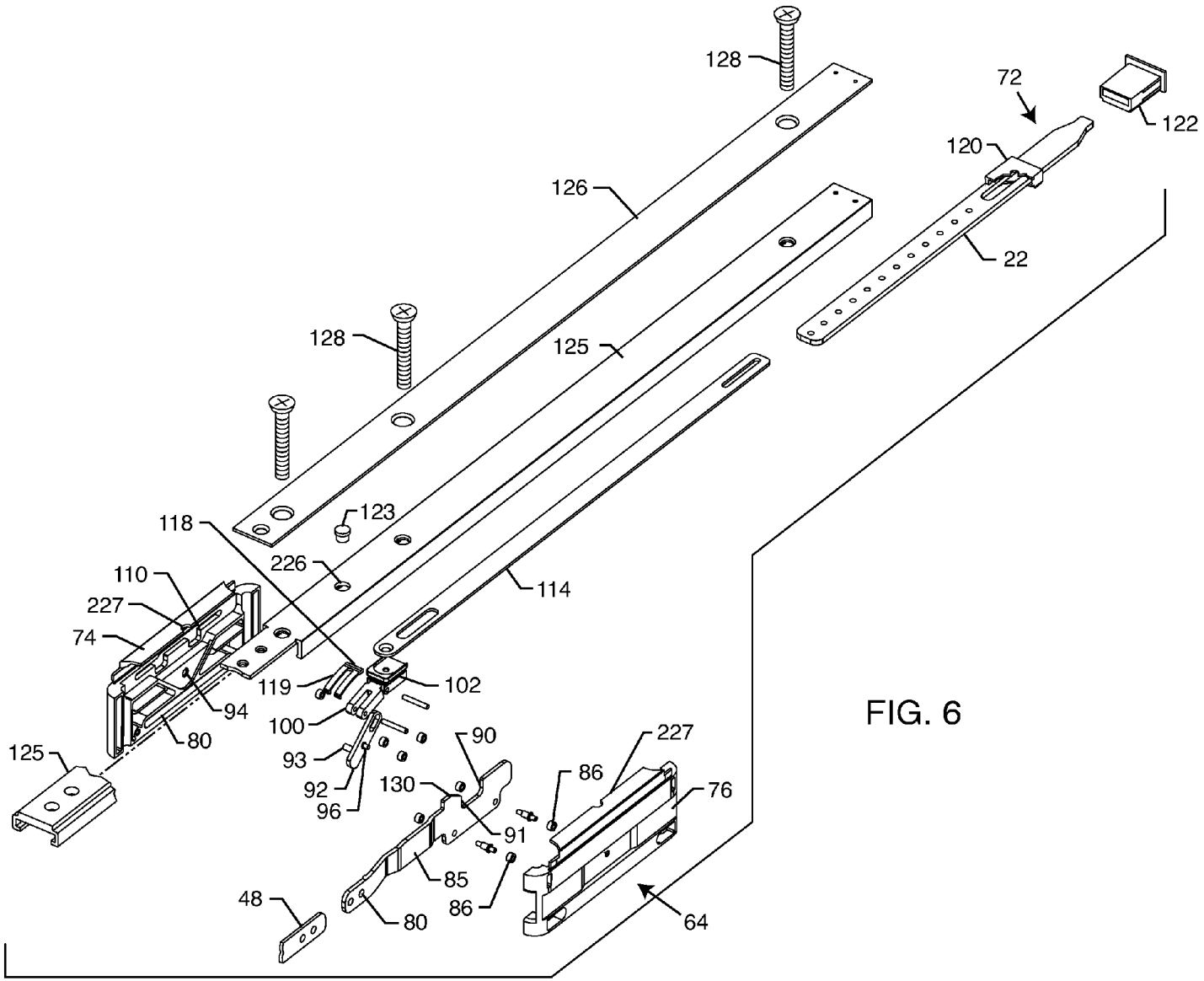
FIG. 6 is an exploded perspective view showing an upper portion of the multipoint lock system, including a header cartridge and an associated header lock pin.
Figure 7:
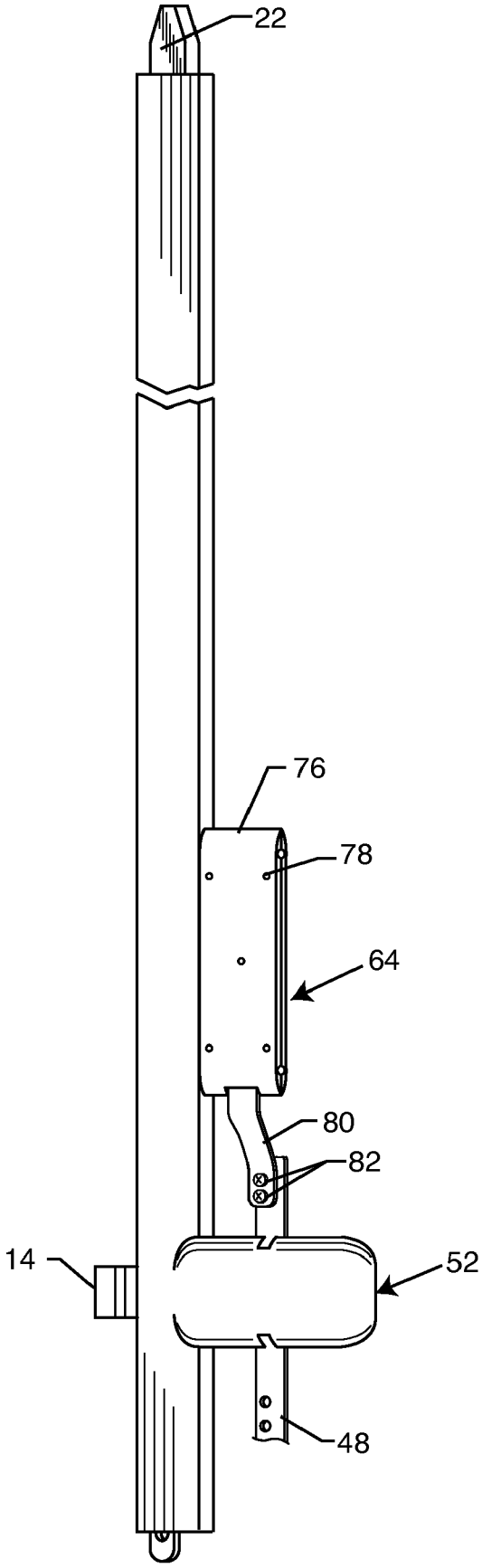
FIG. 7 is an enlarged side elevational view showing in assembled form the upper portion of the multipoint lock system depicted in FIG. 6.
Figure 9:
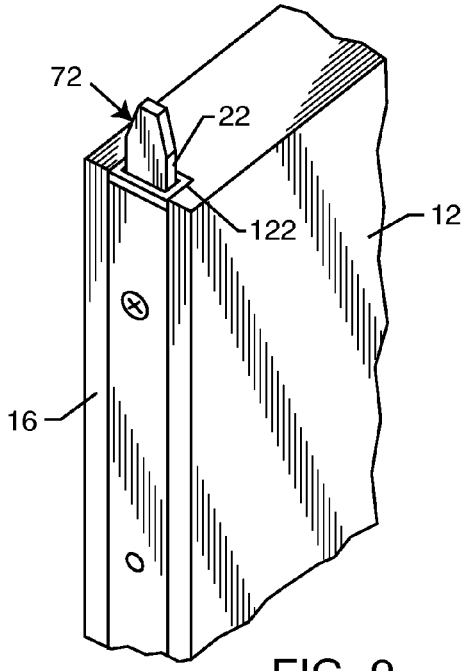
FIG. 9 is an enlarged and fragmented top perspective view of a portion of the door, similar to FIG. 8, but showing the upper header lock pin in an extended deadbolt position.
Figure 10:
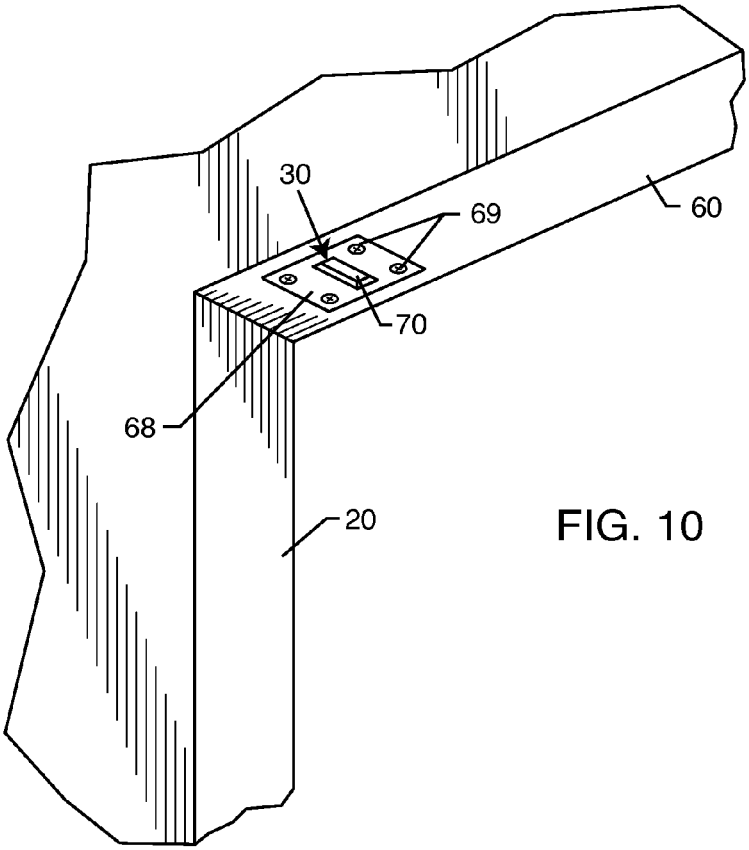
FIG. 10 is an enlarged and fragmented perspective view showing a slotted keeper plate mounted onto the horizontal header of the door frame.
Figure 11:
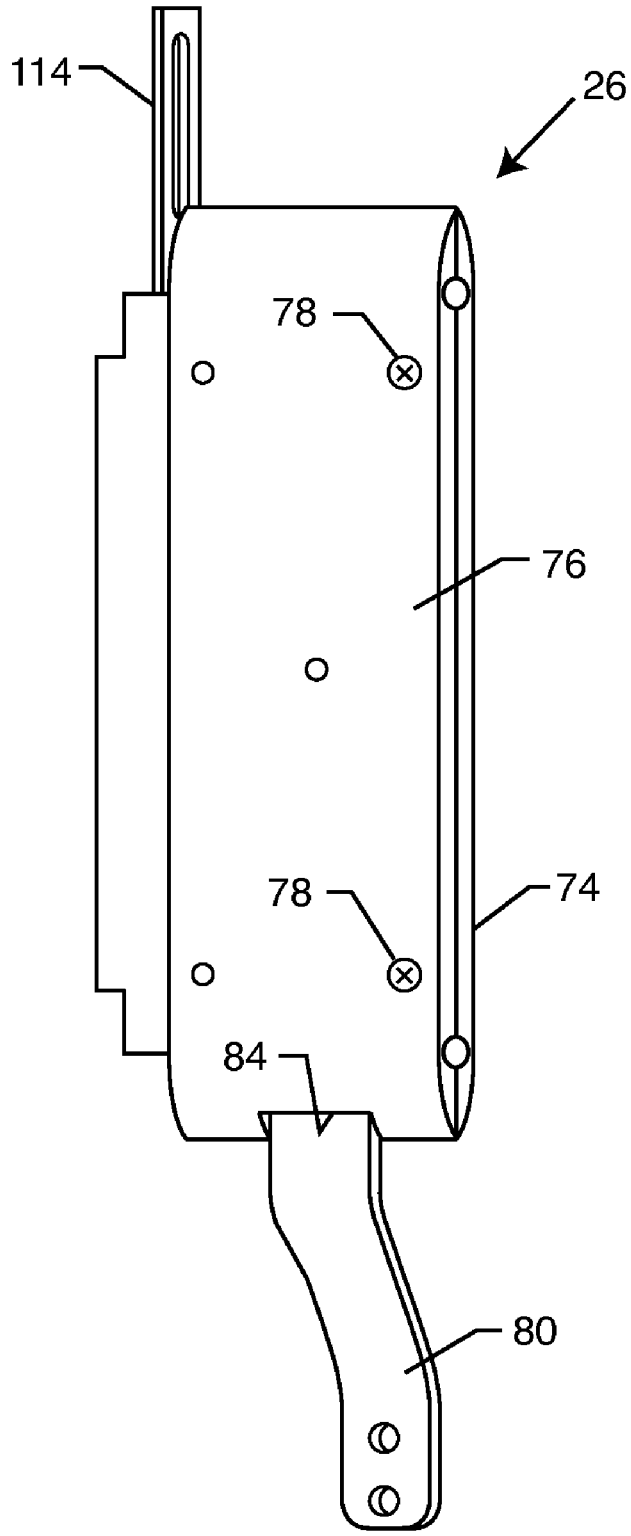
FIG. 11 is an enlarged side elevational view of the header cartridge.
Figure 14:
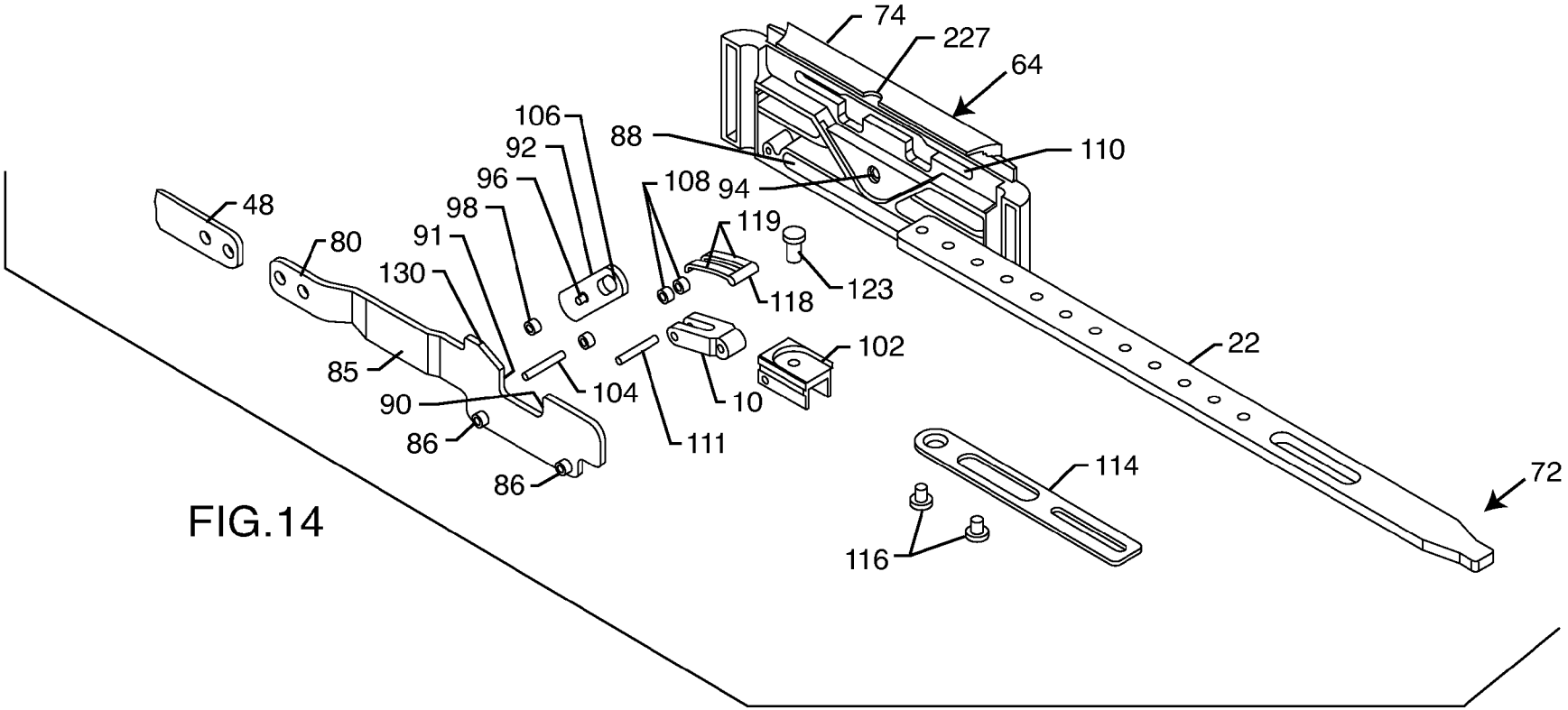
FIG. 14 is an enlarged and exploded perspective of the header cartridge.
Figure 24:
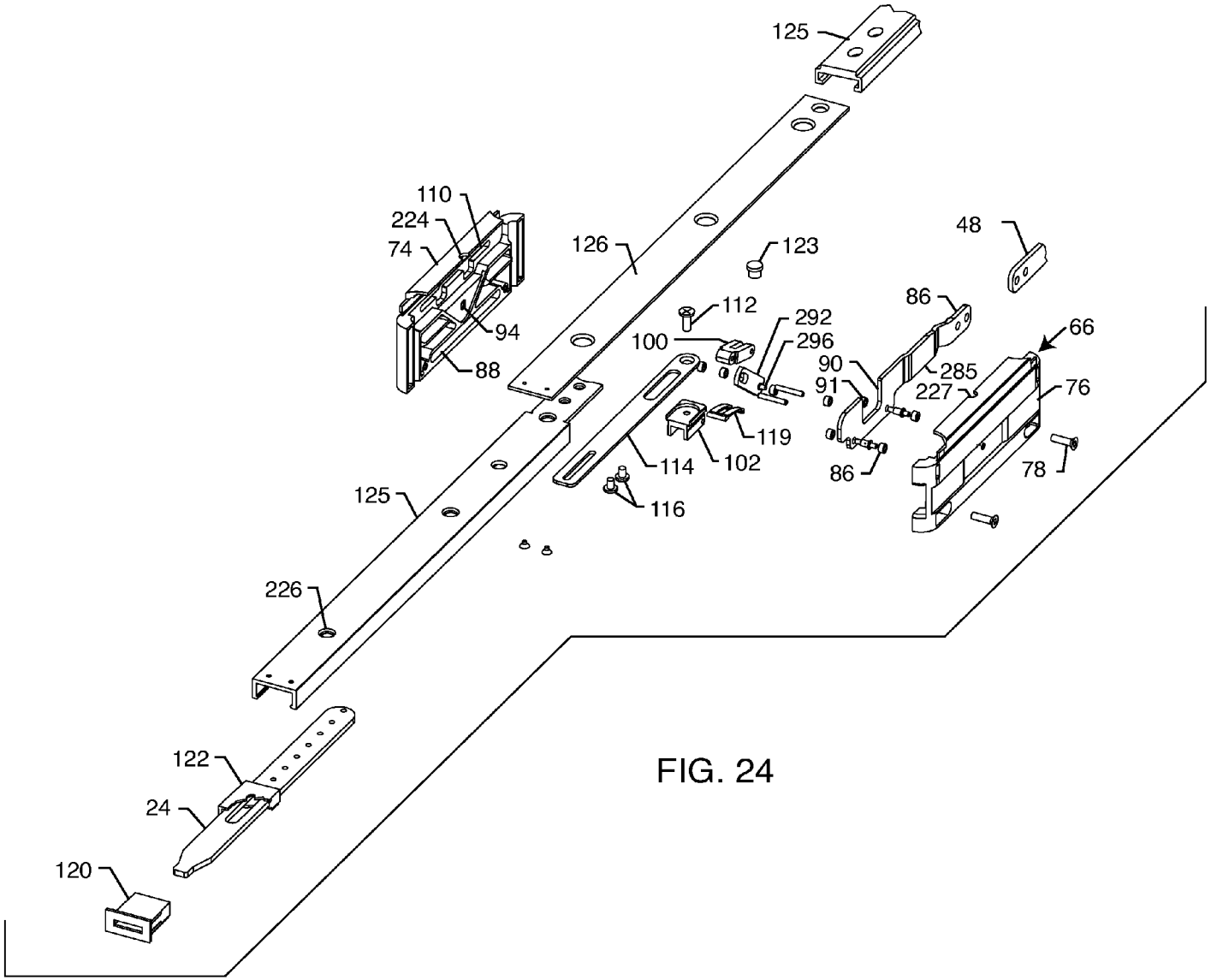
FIG. 24 is an exploded perspective view showing a lower portion of the multipoint lock system, including a sill cartridge and an associated sill lock pin.

FIGS. 6, 9 and 14 show the tip end of the header lock pin 22 with a tapered, upwardly narrowing profile as indicated by arrow 72 to insure and facilitate proper engagement with the associated keeper 30 despite door deformation or bowing or warping in response to temperature differentials, weathering, or aging of the door 12. The tapered tip end of the header lock pin 22 is thus initially engageable within the keeper slot 70 (FIG. 10) as the lock pin 22 is thrown upwardly, with the tapered surface 72 engaging one edge of the slot 70 to draw the upper edge of the door 12 tightly against the frame 40 and any weather stripping (not shown) or the like thereon. FIG. 24 shows the tip end of the lower sill lock pin 24 with a similarly constructed with a downwardly narrowing profile for proper engagement with the sill keeper 32 in the same manner.

In general, the header and sill cartridges 64, 66 each comprise a relative compact housing encasing the associated lost motion mechanism 26, 28 which links the adjacent extension rod 48 with the associated header or sill lock pin 22, 24, as depicted in FIGS. 6-7 and 11-23 with respect to the header cartridge 64, and in FIGS. 24-29 with respect to the sill cartridge 66. In the preferred form, each cartridge housing comprises a pair of generally shell-shaped housing members 74 and 76 adapted for mated assembly and retained in assembled relation by a pair of screws 78 or the like. Each cartridge 64, 66 is sized and shaped for nested fit within a shallow pocket 79 (FIGS. 4 and 5) formed in the door free side edge 16, with the header and sill cartridges 64, 66 positioned respectively between the associated top or bottom edge of the door 12 and the associated upper or lower secondary lock cartridge 52. In a preferred form, the header and sill cartridge housing members 74, 76 may be constructed from a lightweight plastic material.

More particularly, with respect to the header cartridge 64 (FIGS. 6-7 and 11-23), the associated lost motion mechanism 26 comprises an upper drive bar 80 having a lower end adapted for connection as by screws 82 (FIG. 7) or the like to an upper end of the associated extension rod 48. In this regard, as viewed best in FIG. 7, this upper end of the extension rod 48 projects upwardly through and a short distance beyond the associated upper secondary lock cartridge 52. This upper drive bar 80 extends via an open lower-end slot 84 (FIG. 11) into the interior of the header cartridge 64 to define a generally U-shaped cam member or plate 85 (FIG. 12) opening generally in a direction toward the door free side edge. Guide rollers 86 carried on the drive bar 80 within the header cartridge 64 are slidably and guidably received within a facing pair of roller tracks 88 defined on the inboard-facing surfaces of the cartridge housing members 74, 76 to guide the drive bar 80 through a vertically upward and downward reciprocal stroke in response to up-down reciprocal displacement of the extension rod 48 coupled thereto.

Figure 13:
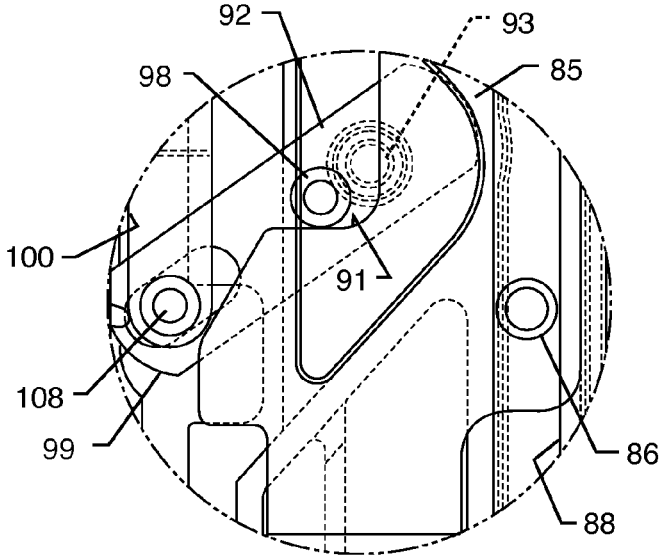
FIG. 13 is an enlarged fragmented elevational view corresponding generally with the encircled region 13 of FIG. 12.
Figure 15:
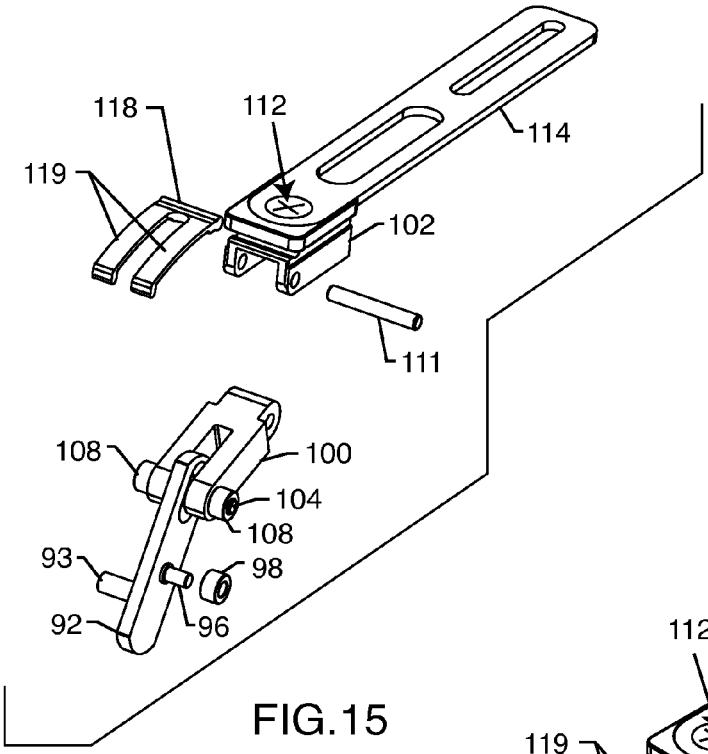
FIG. 15 is an enlarged perspective view of the lost motion mechanism mounted within the header cartridge.
Figure 16:
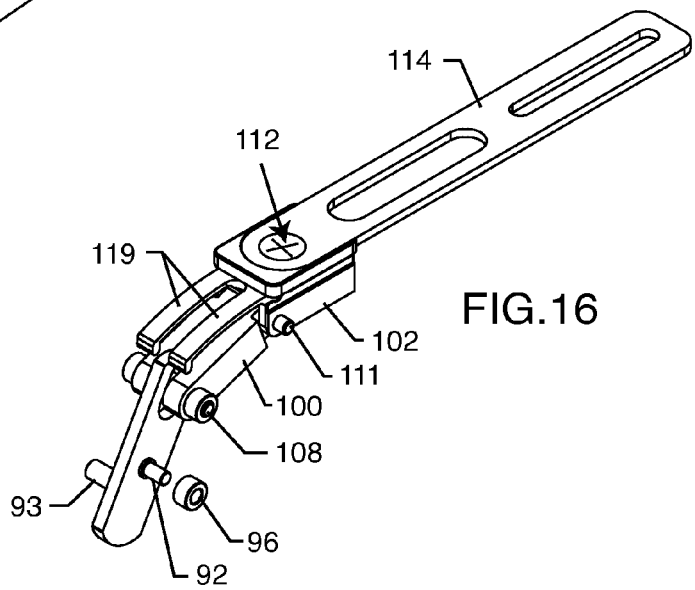
FIG. 16 is a side elevation view of the lost motion mechanism shown in FIG. 15.
Figure 17:
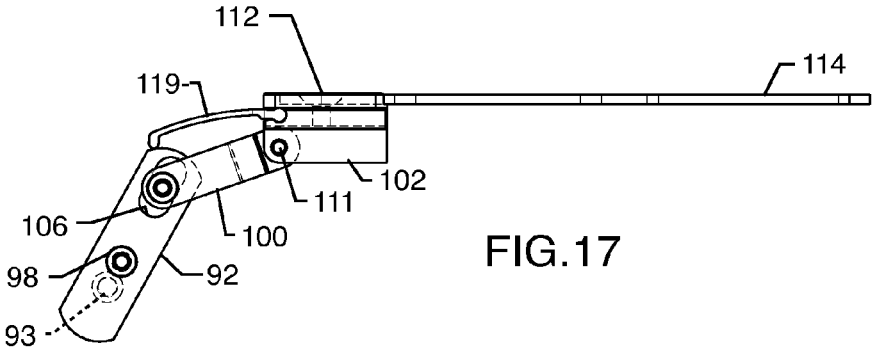
FIG. 17 is an exploded perspective view of the lost motion mechanism of FIGS. 15-16.

The U-shaped cam plate 85 defines an opposed pair of upper and lower cam edges or faces 90 and 91 for respectively engaging a drive link 92 coupled ultimately to the header lock pin 22. This drive link 92, as shown best in FIGS. 15-17, is captured for pivoting movement relative to the header cartridge 64 as by means of a journal pin 93 projecting from one side of the drive link 92 and rotatably seated within a journal port 94 formed in the cartridge housing member 74 (FIG. 13). A cam pin 96 preferably carrying a cam roller 98 projects from the opposite side of the drive link 92 into the space defined by the U-shaped cam plate 85, vertically between the spaced-apart upper and lower cam faces 90, 91 defined thereon. This cam pin 96 is misaligned relative to a rotational axis of the journal link 92, as defined by the journal pin 93 and associated journal port 94, so that the cam pin 96 can be displaced vertically up and down within the header cartridge 64 in response to cam face engagement therewith, to correspondingly swing a free end 99 (generally opposite the cam pin 96 and cam roller 98; see FIG. 13) of the drive link 92 through an up-down stroke. In the header cartridge 64, the cam pin 96 is spaced between the journal pin 93 and the free end 99 of the drive link 92.

The free end 99 of the drive link 92 is coupled in turn (as shown best in FIGS. 15-17) to a cam roller link 100 which is connected in turn to a slide block 102. More particularly, the cam roller link 100 is supported at one end by a short stub axle 104 projecting through an elongated slot 106 formed near the free end 99 of the drive link 92. Opposite ends of this stub axle 104 carry guide rollers 108 captured for sliding and rolling movement within a facing pair of generally U-shaped guide tracks 110 defined on the inboard-facing surfaces of the cartridge housing members 74, 76. The opposite end of the cam roller link 100 is pivotally secured to the slide block 102 as by means of a short pivot pin 111 or the like. The slide block 102 is coupled in turn as by a screw 112 or the like with one end of an elongated adapter link 114, which is in turn coupled as by screws 116 or the like with one end of the associated header lock pin 22. A spring insert 118 includes one or more resilient spring fingers 119 projecting generally from an underside or trailing edge of the slide block 102 to engage the cam roller link 100 near the stub axle 104 thereon, for correspondingly urging and normally retaining the guide rollers 108 into and within short recessed seats defined near the opposite ends of the U-shaped guide tracks 110 (FIG. 14).

Figure 12:
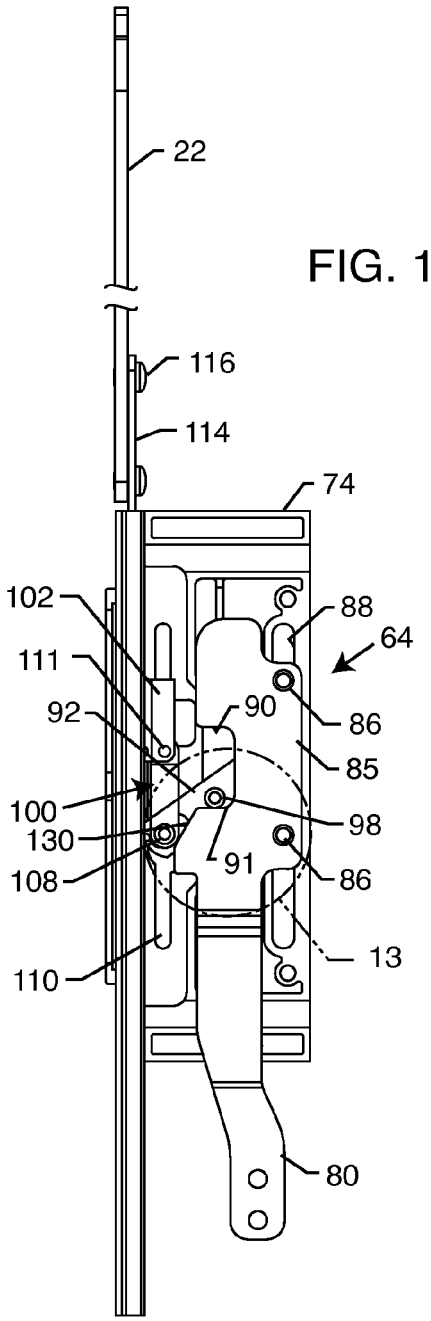
FIG. 12 is an exploded elevation view of the header cartridge shown in FIG. 11, but with cartridge housing members disassembled from each other to show a lost motion mechanism mounted therein, and showing the lost motion mechanism in a normal position for supporting the associated header lock pin in a normal retracted position.

FIG. 12 shows the adapter link 114 coupled to an inboard end or lower end of the associated header lock pin 22 by means of the screws 116 or the like. The header lock pin 22 is slidably supported in turn within a bushing 120 (FIG. 6) and an end cap 122, both of which may be constructed from a suitable low friction plastic material. The adapter link 114 and header lock pin 22 are suitably recessed within an elongated channel 124 (FIG. 4) formed in the free side edge 16 of the associated door 12, with the header cartridge 64 slide-fit assembled with and carried by a channel bracket 125 (FIG. 6). An index pin or screw 123 fits through aligned ports 226 and 227 formed in the channel bracket and the cartridge 64 for proper component positioning and alignment. One or more trim plates 126 (FIGS. 4 and 6) are over these components as by means of suitable screws 128 or the like.

The length of the adapter link 114 can be selected according to the door height dimension, whereby the invention can be fitted quickly and easily onto a door 12 having one of several standard height dimensions. In this regard, FIG. 14 shows the adapter link 114 and the header lock pin 22 formed with multiple open ports for receiving the screws 116 to interconnect these components with selected overall length according to the door height dimension. Alternately, persons skilled in the art will understand that a selection of alternative-length adapter links 114 and/or a selection of alternative-length header lock pins 22 may be provided.

In use, the extension rod 48 normally positions the upper drive bar 80 relative to the header cartridge 64, with the lower face or edge 91 of the U-shaped cam plate 85 engaged with the cam pin 96 and associated cam roller 98 (as viewed in FIG. 12), when the latch bolts 14 are in their normal, partially extended latched positions. In this position, the guide rollers 108 on the cam roller link 100 are engaged with an angularly set pre-lift cam face or edge 130 on the cam plate 85 which shifts the cam roller link 100 and the guide rollers 108 thereon generally to the intersection of a short in-turned lower leg and a vertically elongated slot defining the U-shaped guide tracks 110. Importantly, in this position (FIG. 12), the lost motion mechanism 26 orients the header lock pin 22 in a normal position retracted from the associated header keeper 30.

Figure 18:
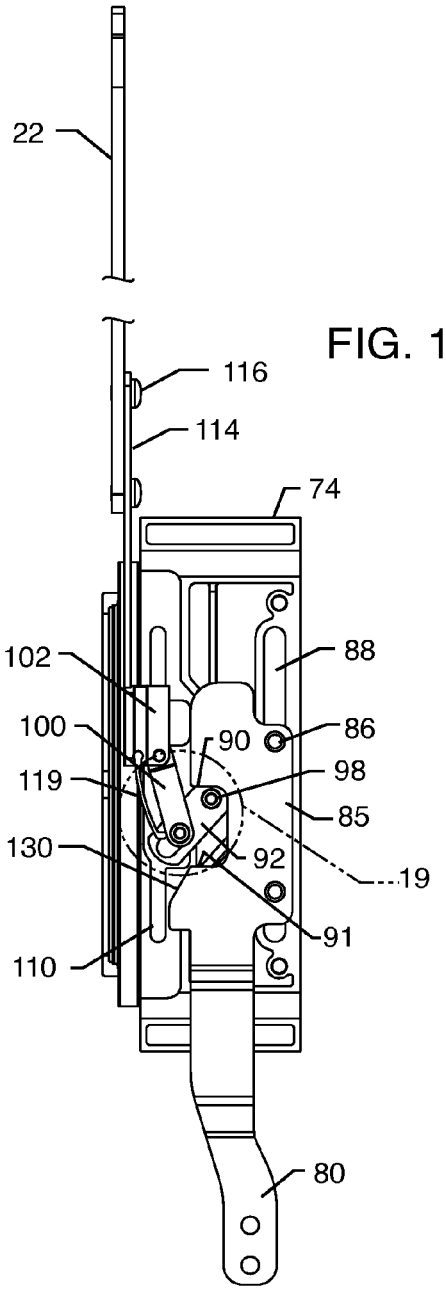
FIG. 18 is an elevational view of a portion of the header cartridge, similar to a portion of FIG. 14, and illustrating the lost motion mechanism in a position corresponding with latch bolt retraction.
Figure 19:
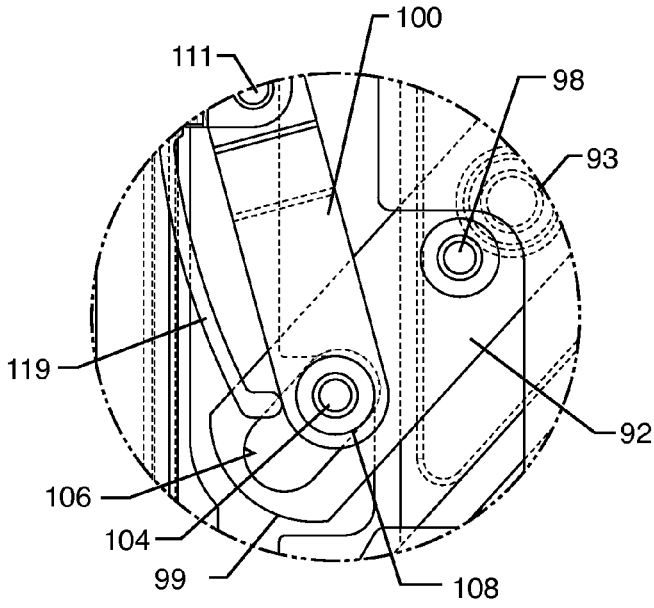
FIG. 19 is an enlarged fragmented elevational view corresponding generally with the encircled region 19 of FIG. 18.
Figure 20:
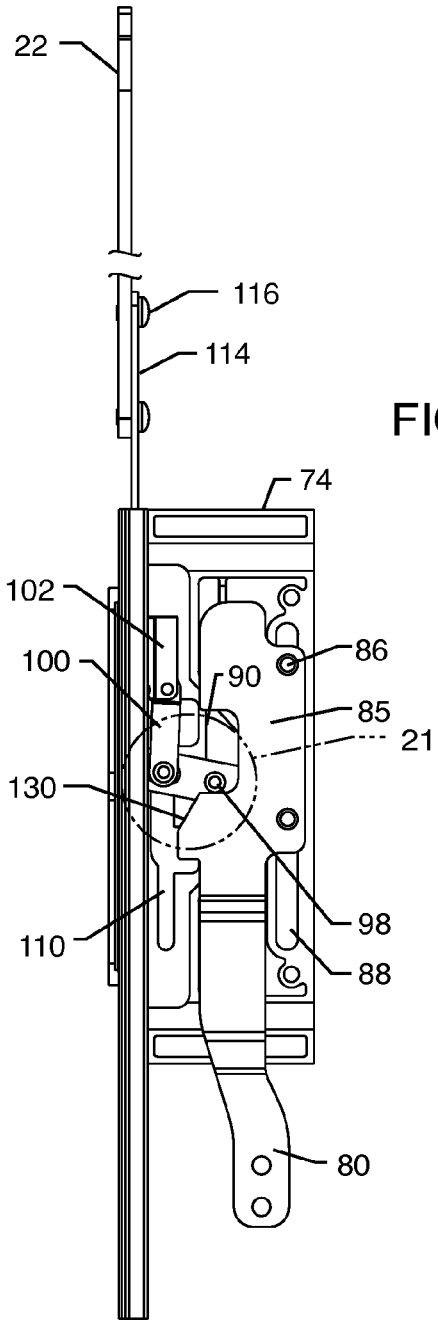
FIG. 20 is an elevational view similar to a portion of FIG. 12, but showing the lost motion mechanism in a partially actuated position for displacing the associated header lock pin to the advanced deadbolt locking position.
Figure 21:
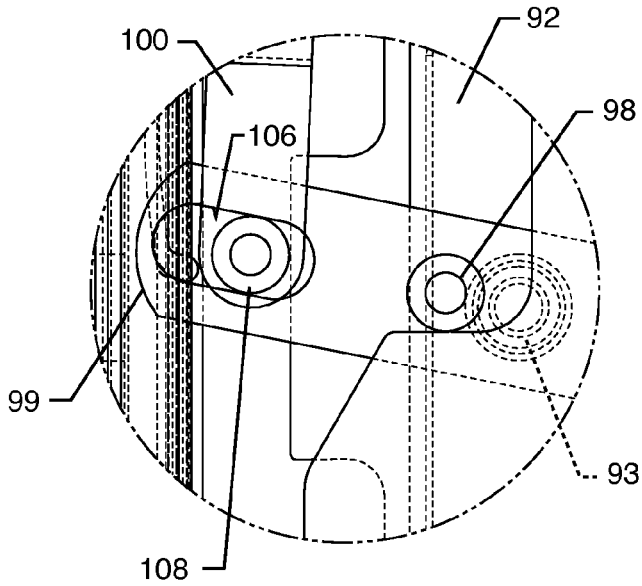
FIG. 21 is an enlarged fragmented elevational view corresponding generally with the encircled region 21 of FIG. 20.

Upon manipulation of the outdoor or indoor lever handles 42, 44 to retract the latch bolts 14 and permit opening of the door 12, the extension rod 48 shifts the U-shaped cam plate 85 on the upper drive bar 80 in a downward direction within the housing members 74, 76 of the header cartridge 64 to shift the upper cam face or edge 90 of the cam plate 85 toward engagement with the cam pin 96 and roller 98 as viewed in FIG. 18. During this downward displacement of the cam plate 85 within the header cartridge 64, the angled pre-lift cam face 130 is displaced downwardly beyond the cam roller link 100 and the guide rollers 108 thereon, thereby permitting the spring fingers 119 of the spring insert 118 to shift the guide rollers 108 positively into the in-turned lower leg of the U-shaped guide tracks 110. Importantly, such downward displacement of the cam plate 85 is thus unaccompanied by any vertical shifting of the cam roller link whereby the header lock pin 22 remains in the normal retracted position.

When the lever handle 42 and/or 44 is released following door opening, spring members incorporated into the main and/or secondary lock cartridges 46 and 52 urge the lever handles 42, 44 and the multiple latch bolts 14 back toward a normal advanced position. Such return displacement of the latch bolts 14 to their normal advanced positions in accompanied by upward return displacement of the drive bar 80 and the cam plate 85 thereon to re-position the lower cam face 91 in engagement with the cam pin 96 and roller 98, and also to re-engage the pre-lift cam 130 with the guide rollers 108 on the cam roller link 100, all as viewed in FIG. 12. Importantly, this downward and upward shifting of the extension rod 48 and drive bar 80 in the course of normal latch bolt movement between the retracted and normal advanced or latched positions does not result in displacement of the header lock pin 22 from its normal retracted position.

Figure 4:
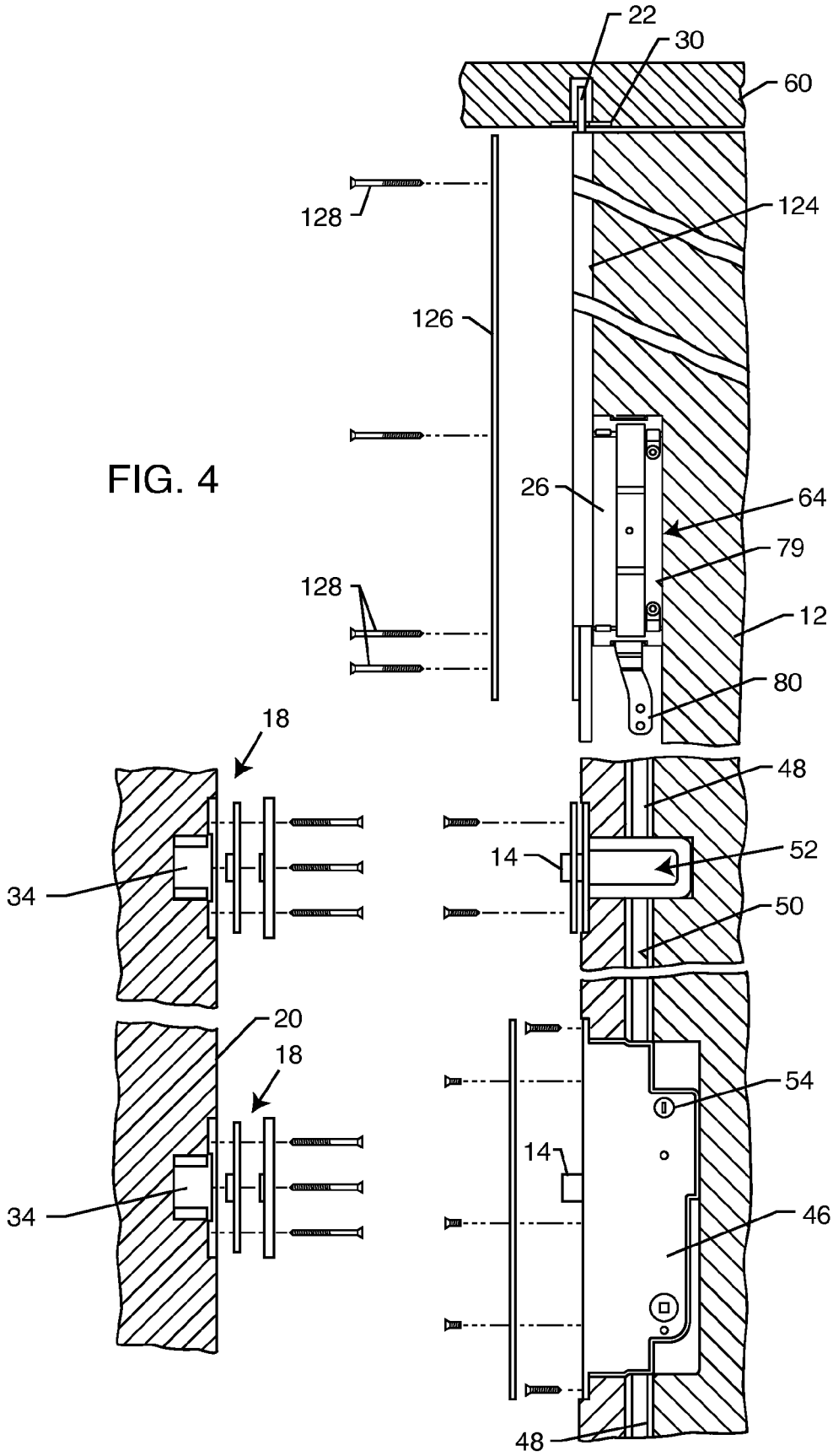
FIG. 4 is an enlarged and fragmented elevational view illustrating an upper portion of the multipoint door lock system of FIGS. 1-3, and depicted in association with strike sets mounted on a vertical stile of an adjacent door jamb, and further depicted in association with a keeper plate mounted on a horizontal header of the adjacent door jamb.
Figure 22:
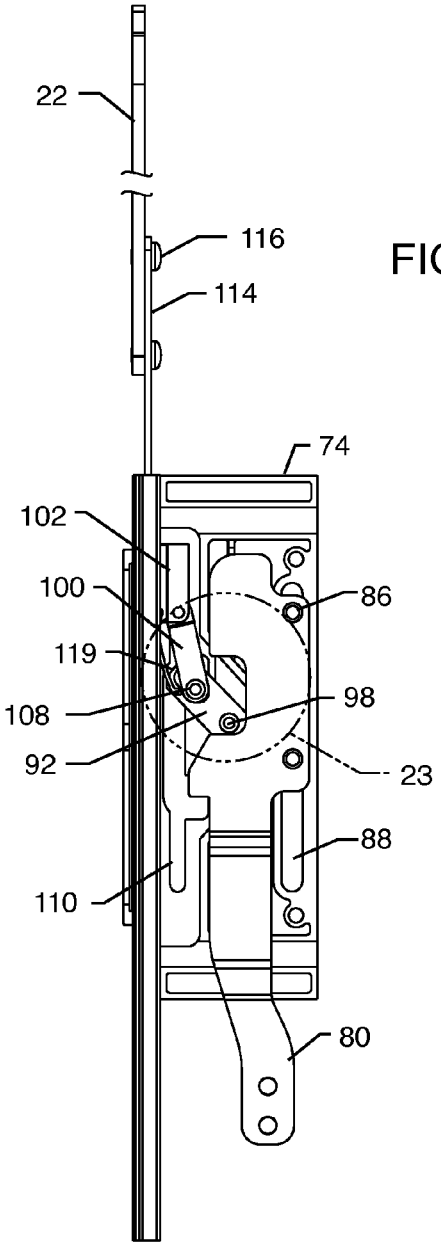
FIG. 22 is an elevational view similar to FIG. 20, but illustrating the lost motion mechanism in a fully actuated position for supporting the associated header lock pin in the extended deadbolt locking position.
Figure 23:
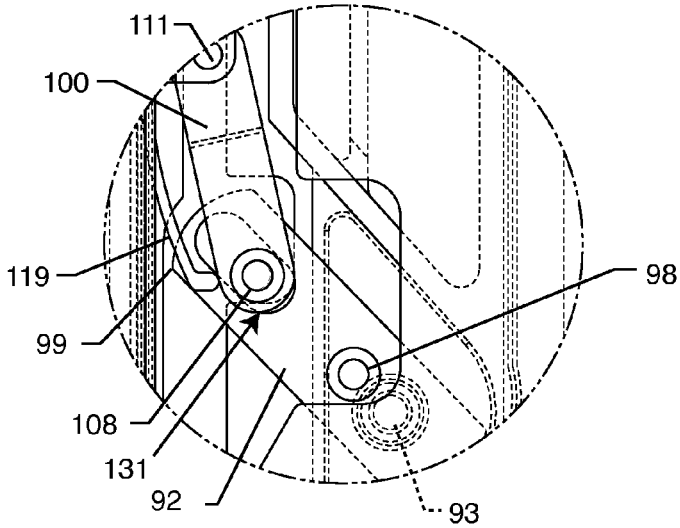
FIG. 23 is an enlarged fragmented elevational view corresponding generally with the encircled region 23 of FIG. 22.

However, when the latch bolts 14 are shifted to from their normal advanced or latched positions to the further extended deadbolt positions, the extension rod 48 shifts the upper drive bar 80 upwardly from the initial position shown in FIG. 12, with the lower cam face 91 of the cam plate 85 engaging the cam pin 96 and roller 98 on the drive link 92. When this occurs, the lower cam face 91 lifts the drive link 92 within the cartridge 64, to correspondingly displace or push the guide rollers 108 on the cam roller link 100 in an upward direction along the vertically elongated segment of the guide tracks 110. This initial upward displacement is viewed in FIGS. 20 and 21. Continued upward displacement shifts the guide rollers 108, and the associated roller link 100 and slide block 102 upwardly to displace the header lock pin 22 (connected to the adapter link 114) to the extended deadbolt position (FIGS. 4 and 22-23). At the upper end this stroke, the spring fingers 118 urge the guide rollers 108 into the in-turned upper leg of the U-shaped guide tracks 110. In this regard, this upper end seat may include a slightly undercut or negative slope wall, as indicated by arrow 131 (FIG. 23), to assist in retaining the lost motion mechanism 26 in the deadbolt position, without inadvertently falling back toward the retracted position.

Accordingly, the header lock pin 22 remains in the retracted position unless and until the latch bolts 14 are advanced to their further extended deadbolt positions, whereupon the lost motion mechanism 26 quickly and easily shifts the pin 22 to the extended deadbolt position. In the preferred form, the lost motion mechanism 26 achieves this deadbolt throw of the header lock pin 22 with a displacement ratio and a substantial mechanical advantage of about 4:1 between the lock pin 22 and the latch bolts 14. In this regard, it will be appreciated that the displacement of the free end 99 of the drive link 92 exceeds the displacement of the cam pin 96 (with the cam roller 98) thereon by a factor of about 4:1.

Upon subsequent return shifting of the latch bolts 14 back toward their normal latched positions, or to the retracted positions, the upper drive bar 80 is initially shifted downwardly to engage and push downwardly on the upper cam face 90 with the cam pin 96 and roller 98 on the drive link 92. The shape of drive link 92 causes the guide rollers 108 on the cam roller link 100 to shift forwardly from the upper in-turned leg of the guide tracks, and then shift downwardly along the guide tracks 110 as the header lock pin 22 is retracted. In this regard, full retraction of the header lock pin 22 requires the latch bolts 14 to be retracted, whereupon spring components (not shown) within the main and secondary lock cartridges 46 and 52 will urge the latch bolts 14 back toward their normal latched positions with the upper drive bar 80 and cam plate 85 in a normal retracted position as viewed in FIG. 12.

The lower or sill cartridge 66 and the lost motion mechanism 28 incorporated therein (FIGS. 24-29) are similarly constructed except that a modified drive link 292 is provided to accommodate displacement of the sill lock pin 24 (FIG. 5) in a direction opposite to the displacement direction of the associated extension rod 48. Accordingly, for ease and clarity of description, the sill cartridge 66 will be described in association with reference numerals common to those used in connection with the above-described header cartridge 64, with the modified drive link 292 and other modified components thereof being referred to by common reference numerals increased by 200.

Figure 26:
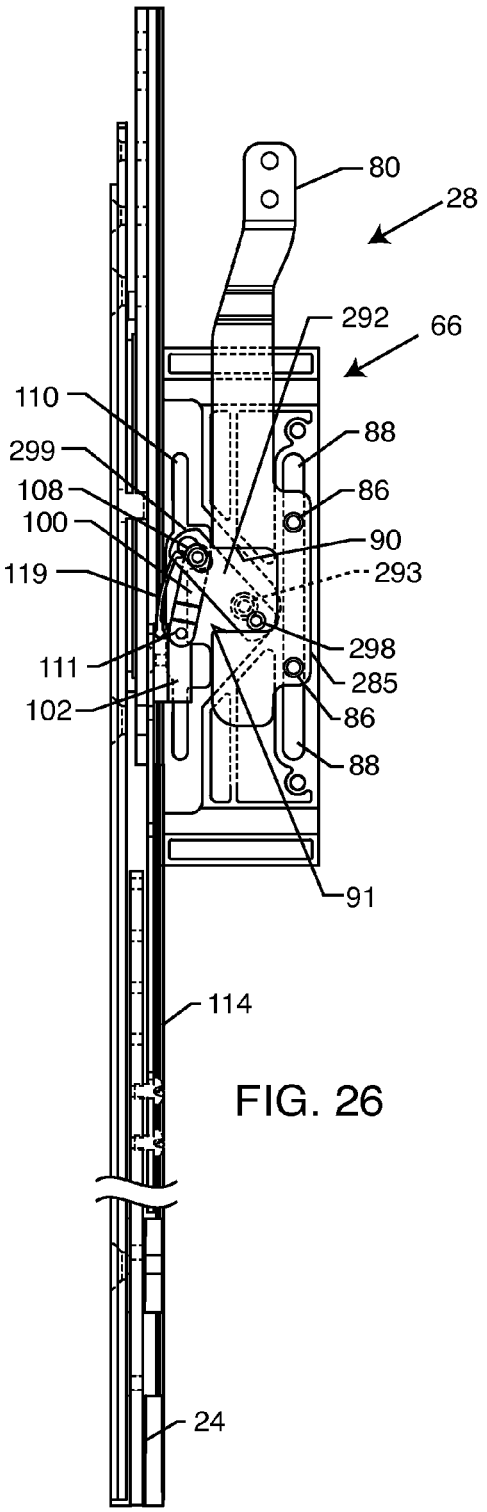
FIG. 26 is an elevational view similar to FIG. 12, but depicting the sill cartridge and lost motion mechanism therein in a normal position for supporting the associated sill lock pin in a normal retracted position.

More particularly, as viewed in FIGS. 24 and 26, a lower drive bar 80 has an upper end projecting upwardly from the sill cartridge 66 for connection to the adjacent lower end of the associated extension rod 48 (FIG. 5). This lower drive bar 80 includes a U-shaped cam plate 285 defining upper and lower cam faces 90, 91 for engaging a cam pin 296 and roller 298 on the modified drive link 292. Guide rollers 86 on the drive bar 80 are captured within vertically elongated guide tracks 88 formed in the cartridge housing members for guiding the drive bar 80 through a vertical up-and-down stroke. Like the header cartridge 64, when the latch bolts 14 are in a normal latched position, the lower cam face 91 of the cam 85 is engaged with the cam pin 296 and roller 298 on the drive link 292, as viewed in FIG. 26.

Figure 25:
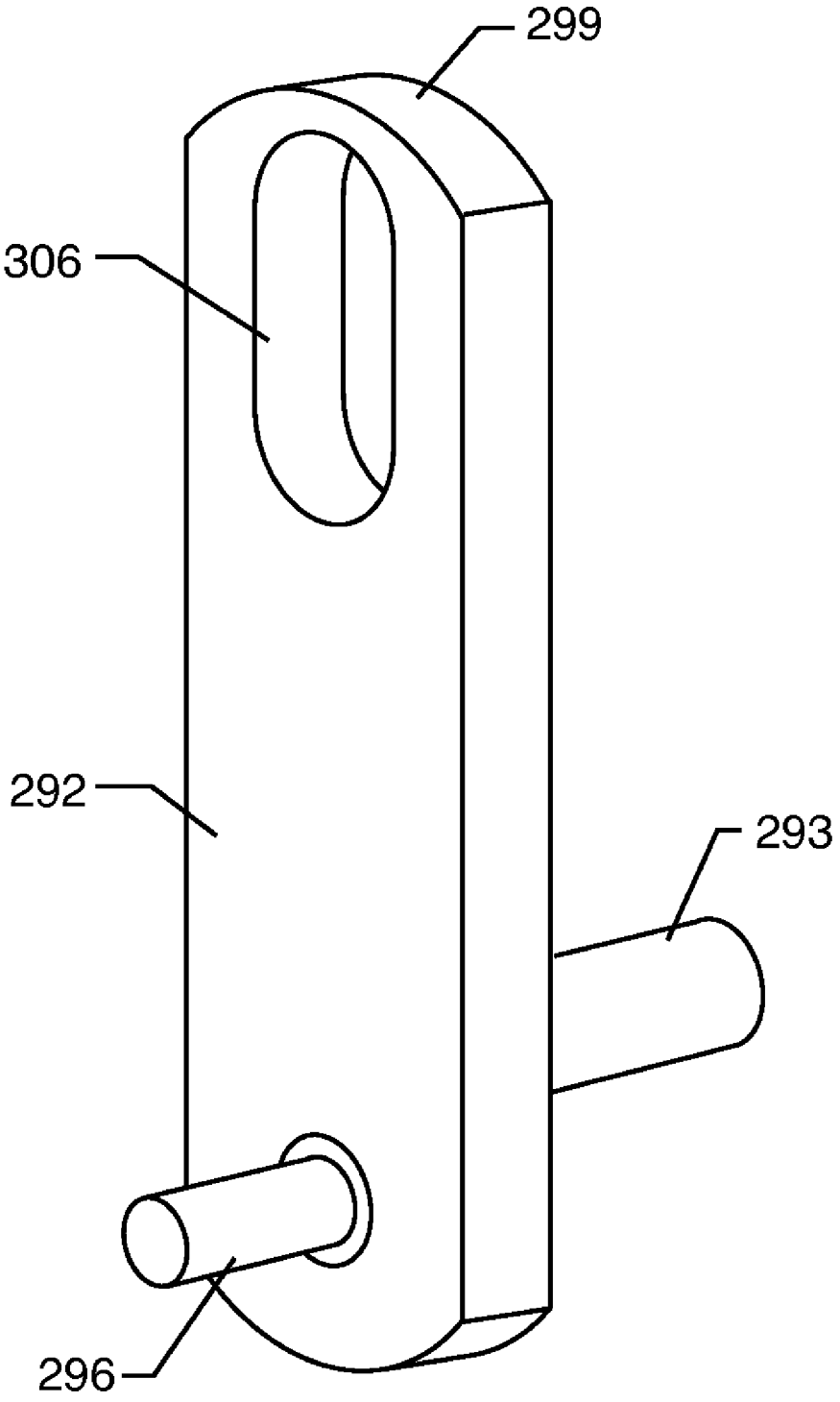
FIG. 25 is an enlarged perspective view depicting a drive link forming a portion of the lost motion mechanism mounted within the sill cartridge.

The drive link 292 is shown in perspective in FIG. 25. The drive link 292 is supported by a journal pin 293 for pivoting movement relative to the cartridge housing members, to displace a free end 299 having an elongated slot 306 formed therein through a vertically up-and-down stroke. This free end 299 of the drive link 292 is coupled to a cam roller link 100 having a stub axle 104 extending through the slot 306, and guide rollers 108 guidably carried within a U-shaped track 110 defined cooperatively by the cartridge housing members 74, 76. An opposite end of the cam roller link 100 is pivotally connected by a pivot pin 111 with a slide block 102 which is connected in turn as by a screw 112 via an adapter link 114 of suitable length to the associated sill lock pin 24 (FIG. 5). A spring insert 118 includes one or more resilient spring fingers 119 projecting generally from an upper side or leading edge of the slide block 102 to engage the cam roller link 100 as by engaging the guide rollers 108, for correspondingly urging and normally retaining the guide rollers 108 into and within short in-turned legs defined at the opposite ends of the U-shaped guide tracks 110 (FIG. 24).

Figure 27:
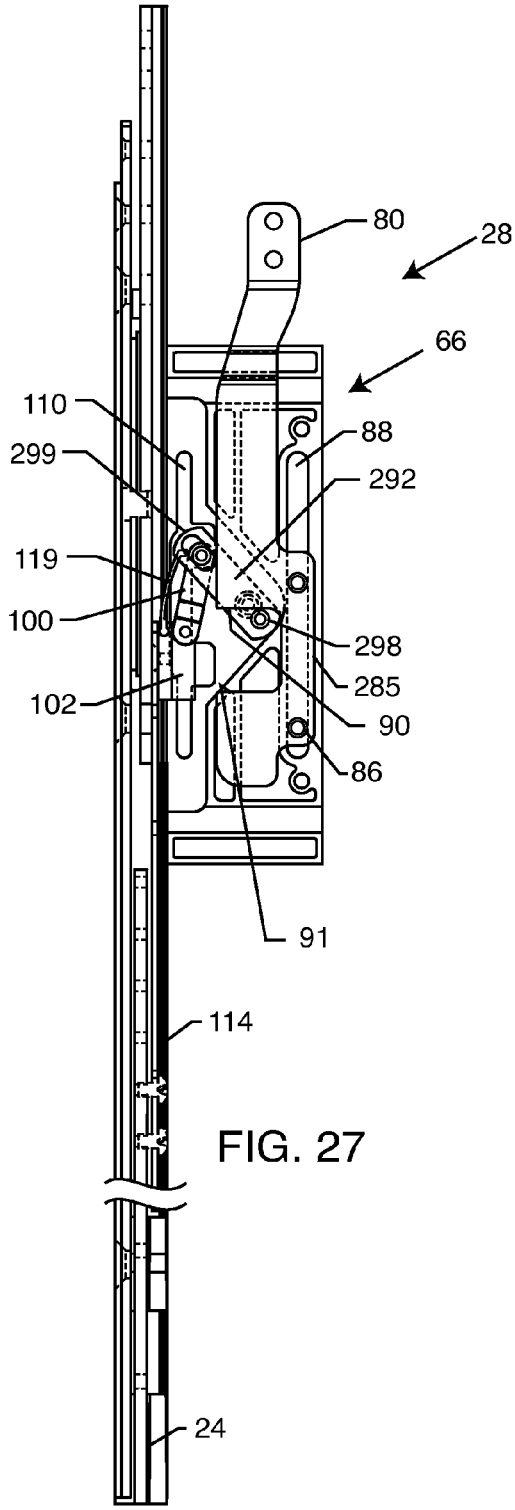
FIG. 27 is an elevational view similar to FIG. 26, but depicting the lost motion mechanism of the sill cartridge in a shifted position corresponding with latch bolt movement to a retracted position for opening of the door.
Figure 28:
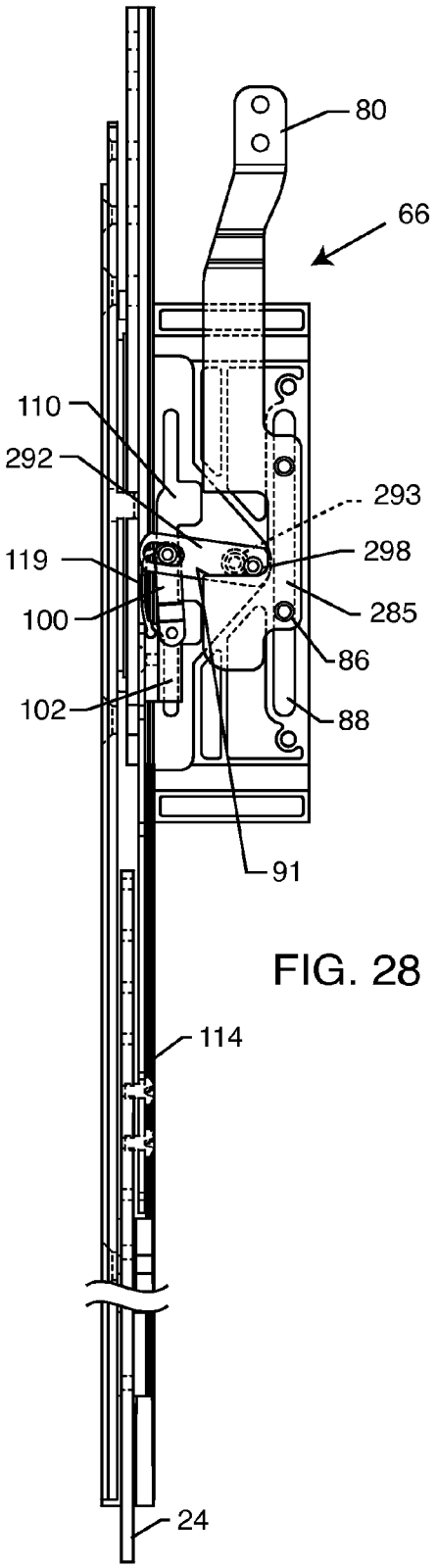
FIG. 28 is an elevational view similar to FIG. 27, but showing the lost motion mechanism of the sill cartridge in a partially actuated position of movement for displacing the sill lock bolt from the normal retracted toward an extended deadbolt position.

In operation, when the latch bolts 14 are displaced from their normal latched positions to retracted positions for door opening, the drive bar 80 and cam plate 85 thereon are shifted downwardly through a short stroke within the sill cartridge 66 to displace the upper cam face 90 toward with the cam pin 296 and roller 298 on the drive link 292 (FIG. 27). Conversely, as the latch bolts 14 are shifted from their retracted positions back toward their normal latched positions, the lower cam face 91 is shifted back upwardly toward engagement with the cam pin 296 and roller 298 on the drive link 292 (FIG. 26). Throughout this up-down shifting movement of the drive bar 80 and associated cam plate 85, as the latch bolts 14 are shifted back-and-forth between the normal latched and the retracted positions, the lost motion mechanism 28 within the sill cartridge 66 does not shift the sill lock pin 24 from a normal retracted position with the guide rollers 108 on the cam roller link 100 supported within the in-turned upper end or recessed seat defined by the associated guide tracks 110. This upper end recess may be formed with a slight negative slope as by undercutting by a few degrees, as indicated by arrow 132 (FIG. 29), to prevent the sill pin mechanism from falling inadvertently toward an extended deadbolt position.

Figure 29:
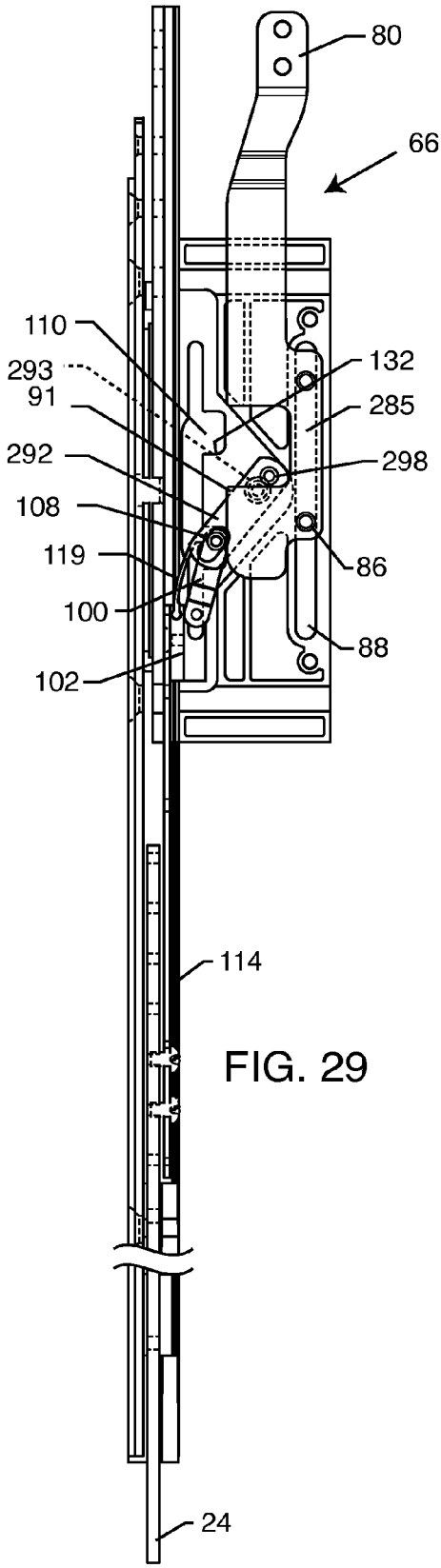
FIG. 29 is an elevational view similar to FIG. 28, but illustrating the lost motion mechanism of the sill cartridge in a fully actuated position for supporting the associated sill lock pin in the extended deadbolt locking position.

However, as the latch bolts 14 are shifted from their normal latched positions toward the further extended deadbolt positions, the drive bar 80 and associated cam plate 85 are lifted to draw the lower cam face 91 against the cam pin 296 and roller pin 298 on the drive link 292 (FIG. 26). In this regard, to achieve sill pin throw in an opposite direction, namely, downwardly, relative to upward displacement of the guide bar 80, the cam pin 296 on the modified drive link 292 is offset or spaced from the associated journal pin 293 in a geometry different from the driven link 92 of the header cartridge 64. That is, in the sill cartridge 66, and as viewed best in FIG. 25, the journal pin 293 is disposed between the cam pin 296 and the drive link fee end 299. With this geometry, upward drive bar and cam plate displacement causes the free end 299 of the drive link 292 to shift the guide rollers 108 on the cam roller link 110 from the in-turned upper end recess of the guide tracks 110 (FIG. 28) and displace or kick the cam roller link 100 and slide block 102 downwardly toward the in-turned lower end leg or recess of the guide tracks 110 (FIG. 29). This motion effectively throws the sill lock pin 24 downwardly to the extended deadbolt position. Return displacement of the drive bar 80 and cam plate 85 in the course of returning the latch bolts 14 to the normal range of motion between the normal latched and retracted positions is accompanied by return movement of the sill lock pin 24 to the retracted position, in the same manner as previously shown and described herein with respect to the header lock pin 22.

A variety of further modifications and improvements in and to the improved door lock system 10 of the present invention will be apparent to those persons skilled in the art. Accordingly, no limitation on the invention is intended by way of the foregoing description and accompanying drawings, except as set forth in the appended claims.

What is claimed is:

1. In a lock system having at least one latch bolt movable normally between an intermediate advanced position for retaining a swinging closure panel in a closed position, and a retracted position for permitting opening of the swinging closure panel, said at least one latch bolt being further extendable from the intermediate advanced position to an extended deadbolt position, the improvement comprising:

at least one header/sill pin mountable to the swinging closure panel for sliding movement between a normal retracted position and a deadbolt position for engaging an adjacent header/sill keeper to retain the closure panel in a closed position in response to an actuator mechanism that moves said at least one latch bolt between said intermediate advanced position and said extended deadbolt position, whereby said at least one header/sill pin is in said normal retracted position during movement of said at least one latch bolt between said intermediate advanced and retracted positions; and at least one header/sill cartridge movably supporting said at least one header/sill pin, said header/sill cartridge including a lost motion mechanism for retaining said header/sill pin in said retracted position throughout displacement of said at least one latch bolt between said advanced and retracted positions, said lost motion mechanism being responsive to displacement of said latch bolt between said advanced and said extended deadbolt positions for respectively displacing said header/sill pin between said advanced and said deadbolt positions;

wherein said lost motion mechanism comprises a driven cam member having a pair of spaced-apart cam faces for engaging a drive link coupled to said header/sill pin, said cam member being shifted back and forth in response to displacement of said latch bolt between said retracted and advanced positions substantially without displacing said drive link, said cam member engaging and displacing said drive link for displacing said header/sill in between said retracted and said deadbolt positions upon respective displacement of said latch bolt between said advanced and said extended deadbolt positions.

2. The lock system of claim 1 wherein said at least one header/sill pin comprises a header pin and a sill pin disposed respectively at a header and sill of the closure panel.

3. The lock system of claim 1 wherein said at least one latch bolt comprises a main latch bolt mountable generally at a mid-height location on a free side edge of the swinging closure panel and at least one secondary latch bolt mountable on the free side edge of the swinging closure panel in vertically spaced relation with said main latch bolt, wherein said actuator mechanism movably displaces said main and secondary latch bolts together between said retracted and advanced positions, and to said further extended deadbolt position.

4. The lock system of claim 3 wherein said at least one secondary latch bolt comprises an upper secondary latch bolt mountable on the closure panel free side edge in vertically spaced relation above said main latch bolt, and a lower secondary latch bolt mountable on the closure panel free side edge in vertically spaced relation below said main latch bolt.

5. The lock system of claim 3 wherein said actuator mechanism comprises a main lock cartridge movably supporting said main latch bolt, at least one secondary lock cartridge movably supporting said at least one secondary latch bolt, and an extension rod coupled between said main lock cartridge and said at least one secondary lock cartridge for movably displacing said main and secondary latch bolts together.

6. The lock system of claim 5 further including at least one header/sill cartridge movably supporting said at least one header/sill pin, said header/sill cartridge being coupled to said extension rod and including a lost motion mechanism for retaining said header/sill pin in said normal retracted position throughout displacement of said main and secondary latch bolts between said advanced and retracted positions, and for displacing said header/sill pin between said retracted and said deadbolt positions upon respective displacement of said main and secondary latch bolts between said advanced and said extended deadbolt positions.

7. The lock system of claim 1 wherein said header/sill pin includes a tip end having a tapered profile shape.

8. The lock system of claim 1 wherein said closure panel comprises a door.

9. In a lock system having at least one latch bolt movable normally between an intermediate advanced position for retaining a swinging closure panel in a closed position, and a retracted position for permitting opening of the swinging closure panel, said at least one latch bolt being further extendable from the intermediate advanced position to an extended deadbolt position, the improvement comprising:

a header pin and a sill pin mountable to the swinging closure panel respectively at a header and sill thereof for sliding movement together between a normal retracted position and an extended deadbolt position by an actuator mechanism, said header and sill pins being retained in said retracted position in response to movement of said at least one latch bolt by said actuator mechanism between said intermediate advanced and retracted positions, said header and sill pins being responsive to movement of said at least one latch bolt between said intermediate advanced and extended deadbolt positions for respective movement of said header and sill pins between said retracted and said deadbolt positions;

a header cartridge movably supporting said header pin and a sill cartridge movably supporting said sill pin, said header and sill cartridges each including a lost motion mechanism comprising a driven cam member having a pair of spaced-apart cam faces for engaging a drive link coupled to said associated one of said header and sill pins, said cam member being shifted back and forth in response to displacement of said latch bolt between said retracted and advanced positions substantially without displacing said drive link, said cam member engaging and displacing said drive link for displacing said associated one of said header and sill pins between said retracted and said deadbolt positions upon respective displacement of said latch bolt between said advanced and said extended deadbolt positions.

10. The lock system of claim 9 wherein said at least one latch bolt comprises a main latch bolt mountable generally at a mid-height location on a free side edge of the swinging closure panel and at least one secondary latch bolt mountable on the free side edge of the swinging closure panel in vertically spaced relation with said main latch bolt, wherein said actuator mechanism movably displaces said main and secondary latch bolts together between said retracted and intermediate advanced positions, and to said further extended deadbolt position.

11. The lock system of claim 10 wherein said at least one secondary latch bolt comprises an upper secondary latch bolt mountable on the closure panel free side edge in vertically spaced relation above said main latch bolt, and a lower secondary latch bolt mountable on the closure panel free side edge in vertically spaced relation below said main latch bolt.

12. The lock system of claim 10 wherein said actuator mechanism comprises a main lock cartridge movably supporting said main latch bolt, at least one secondary lock cartridge movably supporting said at least one secondary latch bolt, and an extension rod coupled between said main lock cartridge and said at least one secondary lock cartridge for movably displacing said main and secondary latch bolts together.

13. The lock system of claim 12 wherein the lost motion mechanism is for respectively retaining said header and sill pins in said normal retracted position throughout displacement of said main and secondary latch bolts between said advanced and retracted positions, and for displacing said header and sill pins between said retracted and said deadbolt positions upon respective displacement of said main and secondary latch bolts between said advanced and said extended deadbolt positions.

14. The lock system of claim 9 wherein said header and sill pins each include a tip end having a tapered profile shape.

15. The lock system of claim 9 wherein said closure panel comprises a door.

* * * * *